US009115481B2

(12) United States Patent
Huber

(10) Patent No.: US 9,115,481 B2
(45) Date of Patent: Aug. 25, 2015

(54) CUTTING WHEEL FOR A TRENCH CUTTER

(71) Applicant: BAUER MASCHINEN GMBH, Schrobenhausen (DE)

(72) Inventor: Ludwig Andreas Huber, Thalhausen (DE)

(73) Assignee: Bauer Maschinen GmbH, Schrobenhausen (DE)

( * ) Notice: Subject to any disclaimer, the term of this patent is extended or adjusted under 35 U.S.C. 154(b) by 74 days.

(21) Appl. No.: 13/933,967

(22) Filed: Jul. 2, 2013

(65) Prior Publication Data

US 2014/0013634 A1 Jan. 16, 2014

(30) Foreign Application Priority Data

Jul. 10, 2012 (EP) ..... 12005091

(51) Int. Cl.

| | |
|---|---|
| ***E02F 5/08*** | (2006.01) |
| ***E02D 17/13*** | (2006.01) |
| ***E02F 3/20*** | (2006.01) |
| ***E02F 3/24*** | (2006.01) |
| ***E02F 9/28*** | (2006.01) |

(52) U.S. Cl.

CPC . *E02F 5/08* (2013.01); *E02D 17/13* (2013.01); *E02F 3/205* (2013.01); *E02F 3/241* (2013.01); *E02F 3/248* (2013.01); *E02F 9/2866* (2013.01)

(58) Field of Classification Search

USPC ..... 37/189, 365, 455, 91

See application file for complete search history.

(56) References Cited

U.S. PATENT DOCUMENTS

| | | | | |
|---|---|---|---|---|
| 5,791,737 | A * | 8/1998 | Cochran | 299/39.8 |
| 7,152,346 | B2 * | 12/2006 | Arzberger | 37/189 |
| 7,178,273 | B2 * | 2/2007 | Arzberger | 37/189 |
| 7,356,947 | B2 * | 4/2008 | Arzberger | 37/189 |
| 7,356,948 | B2 * | 4/2008 | Arzberger et al. | 37/365 |
| 7,401,862 | B2 | 7/2008 | Holl et al. | |
| 7,661,209 | B2 * | 2/2010 | Arzberger et al. | 37/189 |
| 8,640,364 | B2 * | 2/2014 | Arzberger et al. | 37/189 |
| 2005/0000123 | A1 | 1/2005 | Arzberger | |
| 2013/0227862 | A1 * | 9/2013 | Schroeppel et al. | 37/91 |

FOREIGN PATENT DOCUMENTS

| | | | |
|---|---|---|---|
| DE | 10308539 | B3 | 6/2004 |
| EP | 1632610 | A1 | 3/2006 |
| EP | 2020462 | A2 | 2/2009 |
| EP | 2060375 | A1 | 5/2009 |

OTHER PUBLICATIONS

The extended European search report issued on Dec. 19, 2012, which corresponds to EP12005091.9 and is related to U.S. Appl. No. 13/933,967.

The excerpt from Singapore search report issued, which corresponds to Singapore Patent Application No. 201305167-7 and is related to U.S. Appl. No. 13/933,967.

* cited by examiner

*Primary Examiner* — Gary Hartmann

(74) *Attorney, Agent, or Firm* — Studebaker & Brackett PC

(57) ABSTRACT

The invention relates to a cutting wheel for a trench cutter with a drum-like base body, on the outer periphery of which stationary holders are arranged in at least one peripheral row, in which cutting tools for removing ground are received. In the at least one peripheral row chisels with a substantially pointed removal tip and also cutting teeth with a substantially linear cutting edge are arranged as cutting tools. The invention also relates to a method for making a trench in the ground.

13 Claims, 4 Drawing Sheets

CUTTING WHEEL FOR A TRENCH CUTTER

FIELD OF THE INVENTION

The invention relates to a cutting wheel for a trench cutter and to a method for creating a trench in the ground.

The cutting wheel comprises a drum-like base body, on the outer periphery of which stationary holders are arranged in at least one peripheral row, in which stationary holders cutting tools are received for removing ground elements.

DESCRIPTION OF RELATED ART

In order to remove ground elements, different cutting tools are known. For the removal of softer earth and stone layers, for example sandy and cohesive matters such as gravel, in most cases cutting teeth with one or more line-form cutting edges are used. The earth is released substantially by a cutting effect of the cutting edges and carried away. In contrast, in the case of harder ground materials, chisels with a substantially pointed removal tip are used. The pointed tip can break up hard material so that it is split off or chipped away. Depending upon the composition of the ground, cutting wheels with different fittings are used according to the prior art.

When drilling in earth, however, earth and stone layers of different hardness frequently arise in an alternating manner. In this case, at each layer transition between a harder and a softer ground layer the cutting wheels are exchanged or fitted with a new cutting tool set. The trench cutter must therefore be lifted out of the trench created, in case of a layer transition, and lowered back into the trench following successful changing of the cutting wheels or the cutting tools. The exchange of the cutting wheels or the cutting tools requires great time and resources.

EP 2 020 462 A2 shows a trench cutter with a plurality of cutting wheels which are equipped with cutting teeth. The trench cutter is therefore suited in particular for the removal of soft ground types.

A cutting wheel provided with chisels is described in EP 2 060 375 A1.

EP 1632 610 B1 discloses a cutting wheel which is provided with mixing vanes for mixing ground material and suspension.

SUMMARY OF THE INVENTION

The object of the invention is to provide a cutting wheel and a method for making a trench in the ground, whereby particularly economical and rapid making of the trench is facilitated.

The object is achieved according to the invention by a cutting wheel having the features of claim 1 and a method having the features of claim 14. Preferred embodiments of the invention are indicated in the respectively dependent claims.

According to the invention it is provided that in the cutting wheel, in the at least one peripheral row chisels with a substantially pointed removal tip and also cutting teeth with a substantially linear cutting edge are arranged as cutting tools.

It is provided according to the method according to the invention that a trench cutter with at least one cutting wheel formed in this way is incorporated into the ground and the ground is removed by the cutting tools.

A first basic idea of the invention can be seen in that both cutting tools for targeted removal of soft ground and cutting tools for targeted removal of hard ground are provided on the cutting wheel. The cutting wheel according to the invention is thus suited for cutting through different ground layers without the cutting tools having to be changed in the transition between the ground layers. The chisels and the cutting teeth are mounted in separate receiving areas or holders.

By means of the chisels a point-based load is produced on the material to be removed, in particular hard material such as rock, whereby this leads to chipping or splitting off of the material. The removal of the ground thus takes place though a breaking process. The cutting or milling teeth on the other hand are suited for penetration into soft ground so that the removal of ground takes place substantially through a cutting process.

In the case of the chisels, it may be in particular a question of round shank chisels which comprise a shank with a round cross-section. The round shank chisels can be mounted to be rotational in a chisel receiving element, which is preferably designed as a hollow cylindrical bore. Alternatively the shank of the chisel can also have a different cross-sectional form, for example a cornered cross-sectional form.

A second core idea of the invention is that the cutting tools adapted respectively to a certain ground composition are arranged in a common peripheral row or in a common peripheral line around the drum-like base body. The holders for the chisels and for the cutting teeth of a peripheral row hereby lie preferably in a surface perpendicular to the rotation axis of the cutting wheel. This is based upon the recognition that, due to the specific designs of the chisels and the cutting teeth, excess wear of the cutting tools can be avoided if the chisels and the cutting teeth are arranged one behind the other in the rotation direction of the cutting wheel, thus essentially going over the same circle line. In the case of proper operational rotation of the cutting wheel, the chisels automatically provide stronger removal work for hard stone layers than the cutting teeth. In contrast, in case of softer, in particular cohesive ground, the cutting teeth assume a large proportion of the ground removal. It is thus possible to mill through both hard and soft ground layers with the cutting wheel according to the invention without exchanging the cutting tools.

In order to minimise the wear of the cutting teeth when cutting through hard ground layers it is preferable for at least one chisel to be arranged upstream of a cutting tooth in a removal rotation direction of the cutting wheel in such a way that the cutting tooth is disposed in a "removal shadow" of the at least one chisel.

A "removal shadow" is understood in particular to be a region in the peripheral direction of the cutting wheel behind the chisel. The cutting tooth is accordingly arranged preferably at the same axial height of the cutting wheel in the peripheral direction behind the chisel, so that the cutting tooth travels along an annular face already covered by the chisel. In the case of hard stone material, the release of the stone takes place by means of the chisel by breaking up or chipping off the material. Removal of material over a large area hereby takes place in most cases beyond the pointed removal tip by breaking up the material. As a result of the pointed removal tip of the chisel, therefore, sufficient material is generally removed upon rotating the cutting wheel so that the cutting tooth does not come into contact or only comes into slight contact with the ground ahead.

In the case of cutting-through operations of soft ground material, the pointed removal tips of the chisels have on the other hand only a limited removal effect, as no breaking off or splitting of the material can be produced. The removal of ground therefore takes place essentially through the cutting teeth with the linear cutting edge which penetrates into the earth.

In order to further reduce wear of the cutting teeth when removing hard ground material it is advantageous for a plurality of chisels to be arranged upstream of a cutting tooth in a removal rotation direction of the cutting wheel, said chisels being arranged at different setting angles. The cutting edges of the cutting teeth preferably extend in an axial direction of the cutting wheel so that a shovel-like removal of soft ground material can be carried out. In contrast, the pointed removal tips of the chisels respectively cover only a comparatively narrow line. In order to reliably guarantee, in the case of hard ground material, the most extensive clearance possible for the area covered by the cutting teeth, the individual chisels arranged upstream of the respective cutting tooth are angled or inclined varyingly in axial direction so that ground removal lines offset axially relative to each other can be covered by the individual chisels.

It is also possible for the cutting tooth to be axially set. In this case the upstream chisels are preferably adapted to the corresponding orientation of the angled cutting tooth.

A particularly reliable reduction of the wear of the cutting tooth and an effective ground removal in the case of hard stone are achieved in that a group of chisels comprising at least three chisels is formed in the at least one peripheral row, wherein a first chisel is radially orientated as far as possible, a second chisel is laterally angled in an axial direction of the cutting wheel, and a third chisel is laterally angled in an opposite axial direction. The chisels of the group are preferably arranged directly following one another in the rotation direction before a cutting tooth. As a result of the different angling of the chisels, the removal region in axial direction of the cutting wheel is enlarged and a so-called "full cut" can in particular be achieved, in which ground can be removed substantially along the whole axial extension of the cutting wheel.

A further reliable reduction in the wear of the cutting teeth can be achieved by at least one chisel being arranged upstream of a cutting tooth in a removal rotation direction, wherein the removal tip of the chisel projects in a defined manner in radial direction relative to the cutting edge of the cutting tooth. The distance of the removal tip of the chisel from the rotation axis of the cutting wheel is thus greater than a maximum distance of the cutting edge of the cutting tooth from the rotation axis. In case of hard ground, therefore, exclusively the chisels are in contact with the ground ahead, whereas the cutting teeth are set back in relation thereto. In the case of soft ground, on the other hand, the chisels merely comb through narrow lines of the ground, while the main removal work is assumed by the linear cutting edges of the cutting teeth penetrating into the ground.

The cutting teeth are preferably radially set back in relation to the chisels by an amount lying in the range of from a few millimeters to centimeters. An amount of between 5 millimeters and 3 centimeters, in particular between 1 centimeter and 2.5 centimeters, has proved particularly advantageous.

It is provided in a preferred embodiment of the invention that a sheet metal ring is welded to the outer periphery of the drum-like base body, in which sheet metal ring the chisels and the cutting teeth of a peripheral row are arranged. The sheet metal ring thus carries the different cutting tools in the form of chisels and cutting teeth and guarantees the arrangement of the cutting teeth and the chisels in a line or peripheral row around the base body of the cutting wheel. The sheet metal ring extends in a plane perpendicular to the rotation axis of the cutting wheel. It can be formed in one piece or from a plurality of sheet metal ring segments, whereby free spaces or intervals can be formed between individual sheet steel ring segments.

It is preferred according to the invention for the sheet metal ring to comprise radially open first recesses which are adapted to receive the chisels, and radially open second recesses which are adapted to receive the cutting teeth. The first and second recesses are preferably of different design and purposefully orientated to the cutting teeth or the chisels. For example the recesses for the cutting teeth can have a U shape in order to receive cutting teeth with a U-shaped fixing region. In order to receive the chisels or for so-called flat teeth, inclined recesses can be provided in the peripheral direction. The recesses for the flat teeth are hereby preferably more greatly inclined in the peripheral direction than the recesses for the chisels. The cutting teeth or the chisels can be fixed either directly or with additional holders, adapters or sockets in the recesses of the sheet metal ring.

Receiving sockets for releasable support of the chisels and/or the cutting teeth are preferably incorporated into the sheet metal ring. The receiving sockets preferably comprise an insertion opening for receiving a shank of the cutting tool. The receiving sockets can comprise r round receiving openings in particular for receiving round shank chisels or round shank teeth with a round fixing shank. The receiving socket can in particular provide a slide bearing for a chisel, in which a bearing shaft of the chisel is mounted so that it can be rotated around its longitudinal axis extending through the removal tip.

The receiving sockets preferably comprise a dome-shaped base surface for fixing in optionally different orientations to the sheet metal ring. In order to eject a cutting tool received in the receiving socket, an ejection opening can be formed on the receiving socket, which communicates with the receiving opening. By means of an ejector tool the cutting tool can be driven out of the receiving socket.

It is preferable in particular for the provision of a full-cut cutting wheel for the individual receiving sockets, in particular for the chisels, to be arranged in different orientations in the sheet metal ring. The different orientations can relate to axial and/or radial angles. The receiving sockets are preferably releasably fixed to the sheet metal ring. For example the receiving sockets can be welded to the sheet metal ring or pressed into it, whereby they must be knocked out for exchange.

The flexibility of the cutting wheel can be further increased by different types of cutting teeth being arranged in the at least one peripheral row. For example on the one hand cutting teeth for sandy ground and on the other hand cutting teeth for cohesive ground can be used. It is also conceivable to provide cutting teeth for gravel-type ground or softer stone layers.

A plurality of peripheral rows are preferably formed on the outer periphery of the drum-like base body. For effective cutting-through of hard stone layers it is thereby advantageous for exclusively chisels to be arranged in at least one axially outer peripheral row, preferably in both axially outer peripheral rows. The chisels are hereby preferably at least predominantly pointed axially outwards.

The cutting wheel is usually mounted on a trench cutter on a cutting plate. In order to also be able to cut away the region below the cutting plate when the trench cutter is sunk in, it is preferable for at least one chisel and/or cutting tooth to be arranged in a pivotally mounted holder in an axially outer peripheral row. The holder is thereby mounted in such a way that the chisel and/or cutting tooth can be pivoted outwards below the cutting plate and pivoted inwards when passing the cutting plate.

The invention also relates to a trench cutter to produce a trench in the ground, having a frame, on which a plurality of cutting wheels are mounted so that they can be rotated in pairs. The cutting wheels can be driven in rotation via a cutting wheel drive. At least two pairs of cutting wheels which are arranged coaxially with each other are preferably provided on a lower end of the trench cutter. According to the invention at least one cutting wheel is formed on the trench cutter, as described.

According to the inventive method for making a trench in the ground, it is preferable to cut through, in a cutting stage, at least one ground layer with hard ground material which is at least predominantly removed by the chisels, and at least one ground layer with soft ground material which is removed at least predominantly by means of the cutting teeth.

The drum-like base body of the cutting wheel constitutes in particular a hub of the cutting wheel. The hub is preferably formed like a sleeve and can be designed to receive a drive.

During operation of the trench cutter or the cutting wheel the cutting tools are subject to wear. The cutting teeth and the chisels are therefore preferably releasably fixed in the holders of the cutting wheel.

BRIEF DESCRIPTION OF THE DRAWINGS

The invention is further explained below by reference to the attached schematic drawings, in which.

DETAILED DESCRIPTION OF THE PREFERRED EMBODIMENT

Figure 1:
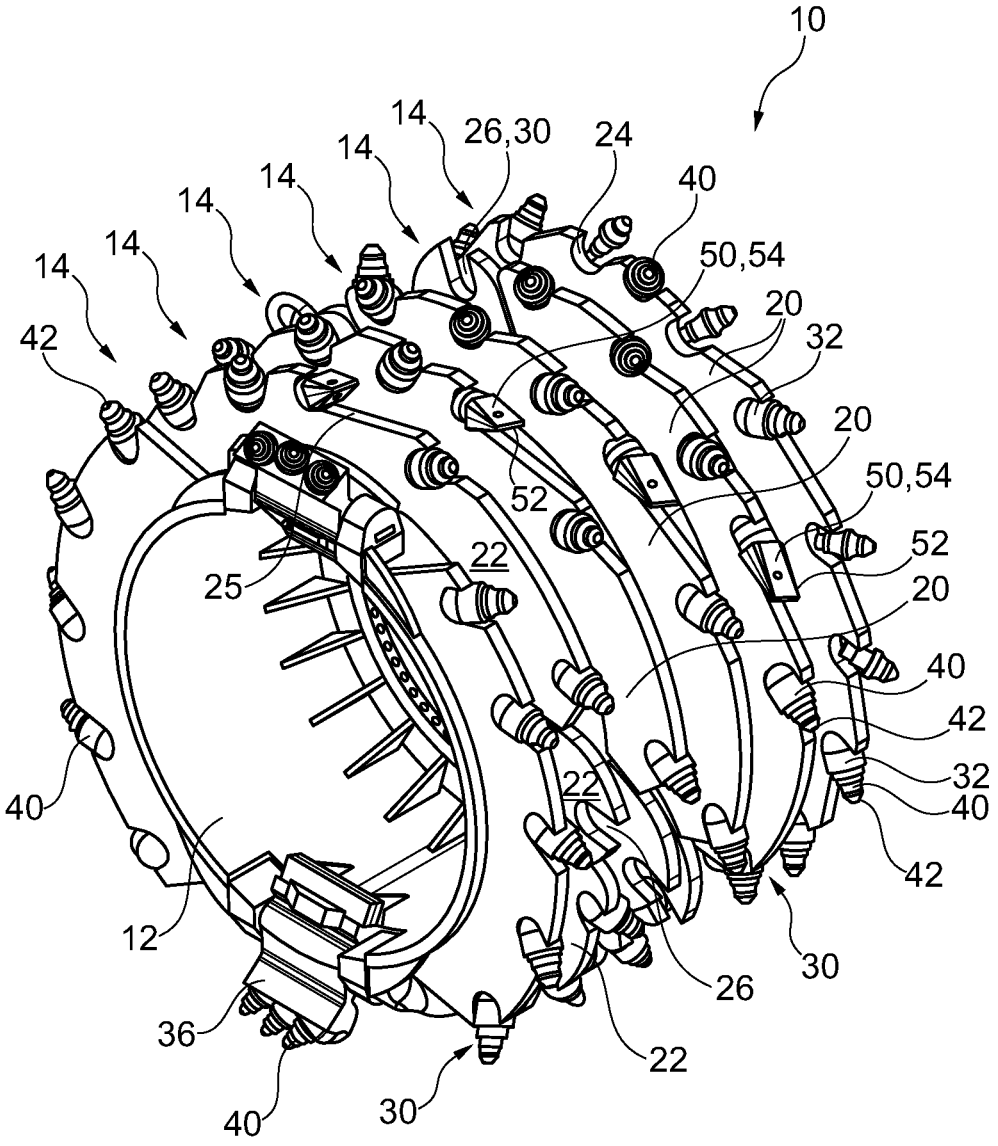
FIG. 1 shows a perspective view of a cutting wheel according to the invention.
Figure 2:
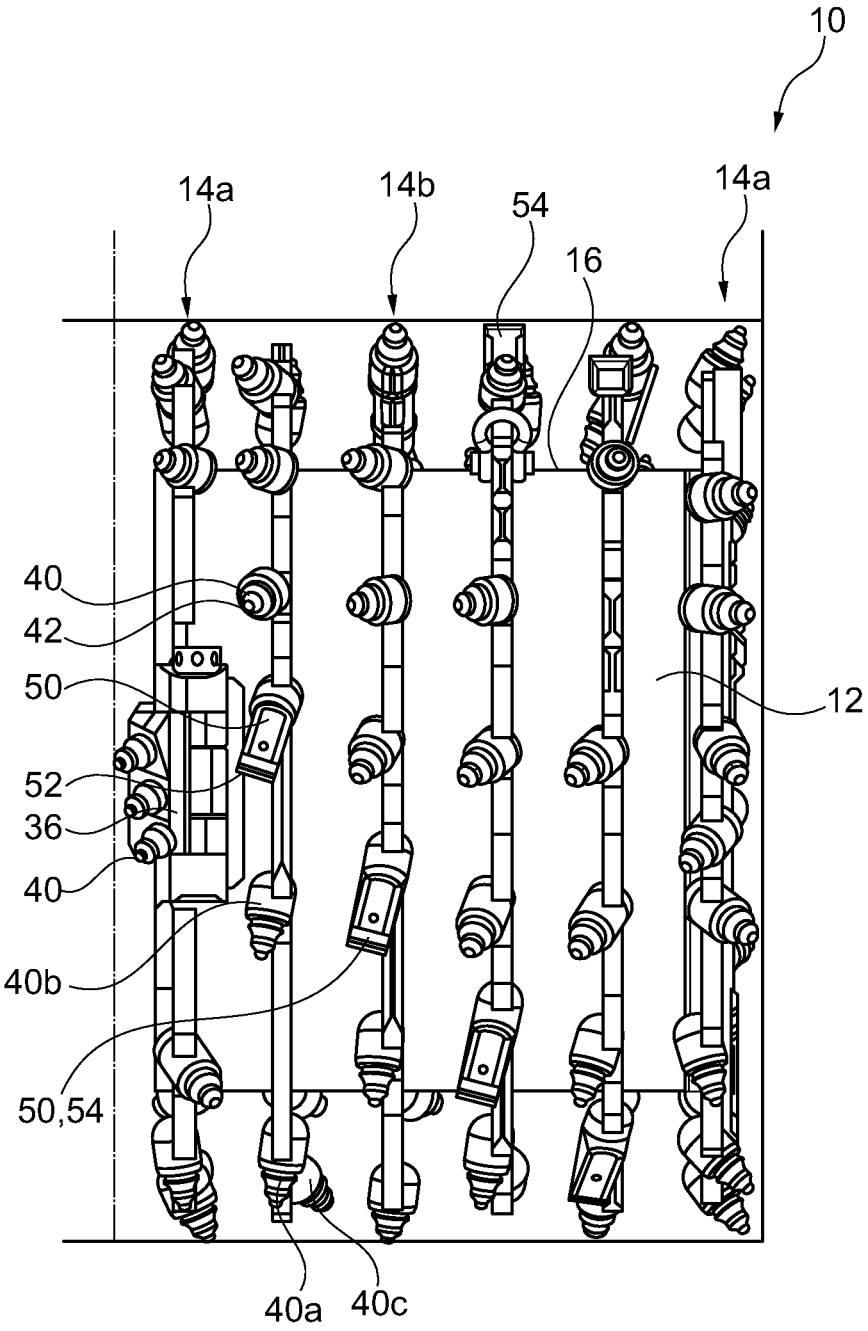
FIG. 2 shows a side view of the cutting wheel.

The same components or those having the same effect are characterised in all the figures with the same reference symbols.

The cutting wheel 10 shown in the figures comprises a drum-like base body 12 which forms a hub of the cutting wheel. A plurality of cutting tools in the form of chisels 40 and cutting teeth 50 are provided on an outer cylindrical shell surface 16 of the cutting wheel 10 in a plurality of peripheral rows 14. In one peripheral row 14, chisels 40 and cutting teeth 50 are arranged alternately.

The cutting wheel 10 comprises a plurality of stationary, thus immovable, holders 30 for receiving and holding the cutting tools. The holders 30 are formed from sheet metal rings 20, into which receiving sockets 32 or chisel holders can be inserted to receive the cutting tools. The chisels 40 and the cutting teeth 50 are arranged in independent receiving areas separate from each other.

The annular outer jacket surface of the cutting wheel 10 carries at predetermined distances in axial direction a plurality of sheet metal rings 20 which extend in a plane perpendicular to the rotation axis of the cutting wheel 10. The sheet metal rings 20 extend radially and in the peripheral direction around the cutting wheel 10 and can be constructed from individual sheet metal ring segments 22. Each individual sheet metal ring segment 22 can carry both chisels 40 and also cutting teeth 50.

Different, radially outwardly open recesses 24, 25, 26 are formed in the sheet metal ring 20, in which the chisels 40 or the cutting teeth 50 can be fixedly held.

The chisels 40 in the embodiment shown are so-called round shank chisels with a cylindrical fixing shank. The chisels 40 have a substantially pointed removal tip 42 which is arranged in a central axis of the chisel 40. The chisels 40 are inserted into the receiving sockets 32 which are formed in a dome shape. The receiving sockets 32 have a receiving bore for receiving the fixing shank. The chisels 40 can be mounted rotationally in the receiving sockets 32.

By way of cutting teeth 50 or milling teeth, the cutting wheel 10 comprises a plurality of flat teeth 54 with a linear blade or cutting edge 52 for removal of ground over a large area. The cutting teeth 50 or flat teeth 54 are likewise received in receiving sockets 32. The cutting edge 52 is located at an axial end of the cutting tooth 50 and extends transversely to the circulation path of the cutting tooth 50 around the rotation axis of the cutting wheel 10. It is designed to penetrate into soft ground material and to remove this over the length of the cutting edge 52. The flat teeth 54 comprise a shank which is inserted into the receiving socket 32 and fixed therein. In addition approximately horseshoe-shaped receiving elements 26 for further cutting or milling teeth with linear cutting edges are provided on the sheet metal rings 20.

A plurality of chisels 40 are arranged upstream of each cutting tooth in the rotation direction of the cutting wheel 10. The chisels 40 arranged upstream of the cutting tooth 50 are fixed at different angles on the sheet metal ring 20. The corresponding receiving sockets 32 are hereby mounted, for easier exchange of the chisels 40, in different orientations fixedly on the sheet metal ring 20 and the chisels 40 are received in an exchangeable manner in the receiving sockets 32.

In order to produce a full cut of the cutting wheel 10, at least some of the chisels 40 are arranged axially in a first direction in the peripheral row 14 and a further chisel 40 is pointed axially in an opposite direction. The chisels 40 arranged upstream of a cutting tooth 50 are adapted to the orientation of the cutting tooth 50. If the cutting tooth 50 is for example axially orientated, the upstream chisels 40 are also correspondingly axially orientated.

In order to minimise the wear of the cutting teeth 50 when cutting through hard stone, for example rock, the chisels 40 can project by a certain amount in radial direction in relation to the cutting teeth 50.

A plurality of chisels 40 are received on a pivotally mounted holder 36 on an axially inner side of the cutting wheel 10 facing the cutting plate. Through the pivotable holder 36, ground can be removed below a cutting plate 4 by pivoting outwards, while the chisels 40 can be pivoted inwards to pass the cutting plate in an upper region. Exclusively chisels 40 are arranged on the outer peripheral rows 14*a*, while both chisels 40 and also cutting teeth 50 are provided according to the invention in each of the inner peripheral rows.

Figure 3:
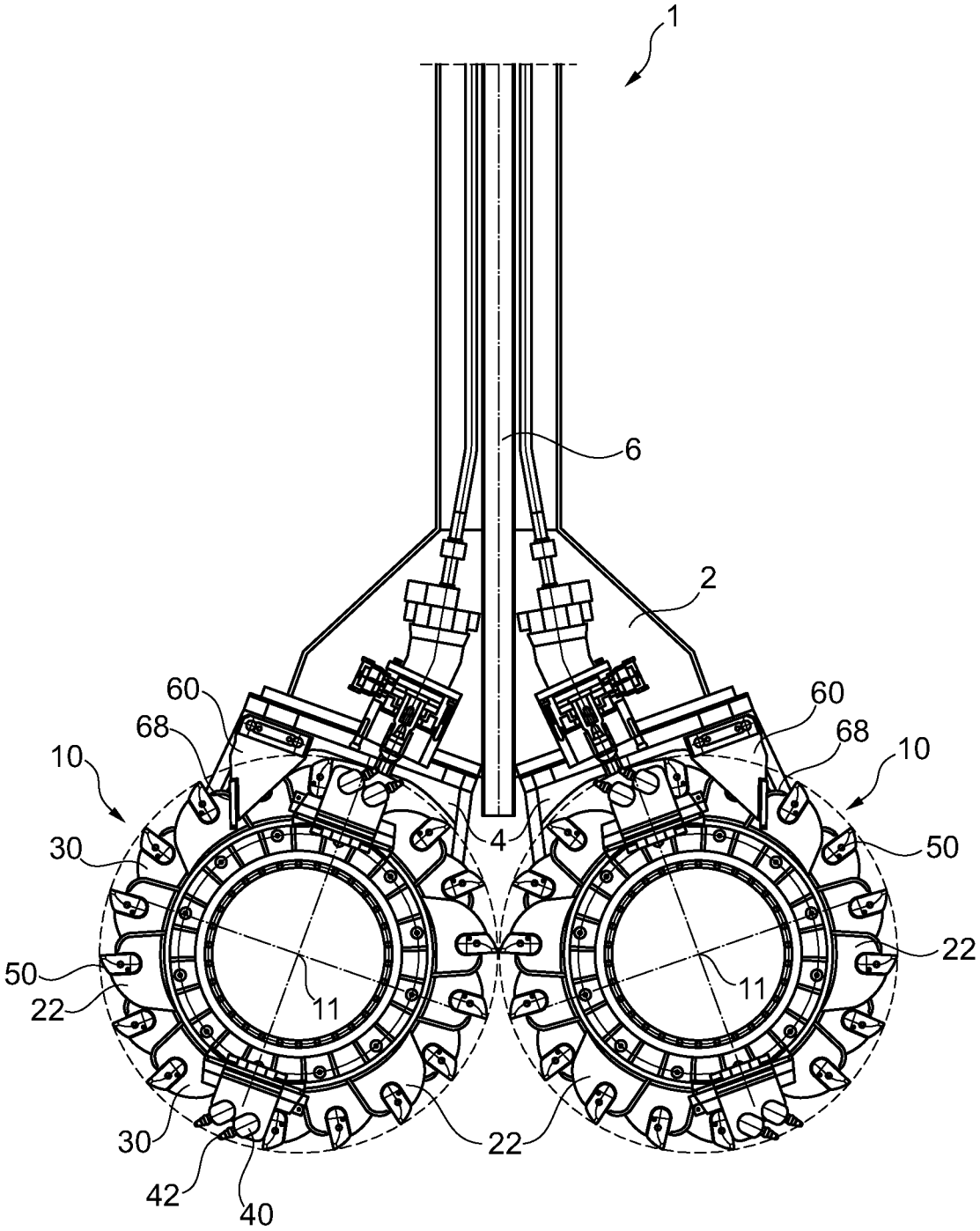
FIG. 3 shows a trench cutter, on which a plurality of inventive cutting wheels are arranged.

FIG. 3 shows a side view of a trench cutter 1 according to the invention with a plurality of cutting wheels 10 with respectively horizontally orientated rotation axis. In this embodiment, stationary cutting teeth 50 and pivotally mounted chisels 40 are arranged in the outer peripheral rows. The trench cutter 1 comprises a frame 2, on which a plurality of cutting wheels 10 are rotationally mounted in pairs. The frame 2 comprises a respective cutting plate 4 for mounting a cutting wheel pair, said cutting plate 4 being arranged respectively between two cutting wheels 10 and carrying the cutting wheels 10. As can be deduced from FIG. 3, the sheet metal ring 20 is formed in the embodiment shown from individual, spaced-apart sheet metal ring segments 22. In order to supply a support medium or a hardenable suspension into the trench or to carry away the ground removed, a conveying line 6 is provided, on the lower end of which an opening is formed.

Spacer plates 60 can engage between the individual peripheral rows 14 of the cutting wheels 10, said spacer plates 60 being fixed to the frame 2 and carrying away ground from an intermediate area 15 between the peripheral rows 14. Two spacer plates 60 for cleaning the region between two respectively adjacent peripheral rows 14 of cutting tools are schematically indicated in FIG. 3. The spacer plates 60 serve in particular to remove soft earth or clay material which can clog the region between the holding plates. In addition to transporting away the ground material, the spacer plates 60 can also be provided and adapted to reduce in size hard material upwardly conveyed by the cutting tools, for example stones. A spacer plate 60 comprises a guiding plate or guiding surface 68 for guiding the ground material. In addition a breaking or reducing edge 70 is provided to reduce stone in size.

Figure 4:
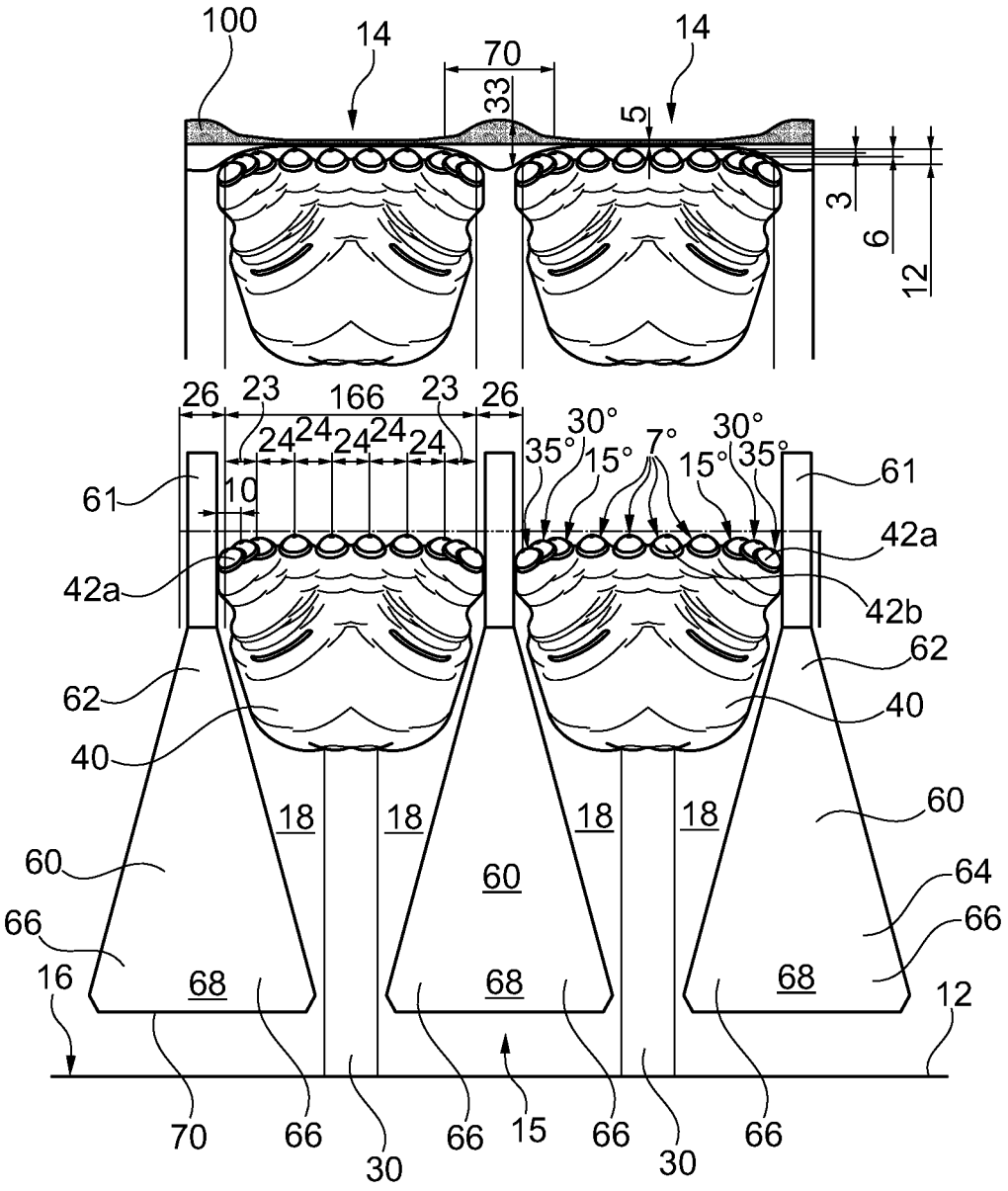
FIG. 4 shows a sectional view of a cutting wheel according to the invention in the region of spacer plates.

FIG. 4 shows a partially sectional view of a cut-out of a cutting wheel 10 along a plane parallel to the rotation axis 11 of the cutting wheel 10. Cutting tools in the form of chisels 40 are arranged, among other things, on a radially outwardly lying region of the plate-form holders 30. As shown in FIG. 4, the chisels 40 can have a width which is greater than a width of the plate-form holders 30. The chisels 40 thus project in axial direction of the cutting wheel 10 in relation to the plate-form holders 30. An undercut region 18 is thus formed between the chisels 40 and the shell surface 16 of the drum-like base body 12 which can also be described as a cutting wheel drum. The undercut region 18 is radially outwardly delimited by the chisels 40.

At least one spacer plate 60 engages in the intermediate space 15 between the peripheral rows 14, said spacer plate 60 being fixed to the frame 2 of the trench cutter 1. The spacer plate 60 comprises a fixing section 61 which is fixed to the frame 2. The spacer plate 60 further comprises a radially outward region 62 between the cutting tools and a radially inward lying free end 64 between two holders 30.

A projection 66 is formed at the free end 64 or on a radially inner region of the spacer plate 60, said projection 66 projecting into the undercut region 18 formed radially within the cutting tool. The projection 66 constitutes a widening of the spacer plate 60. The spacer plate 60 thus has at its free end 64 a larger width than on its radially outer region 62. More specifically, the spacer plate 60 has a larger width at its free end 64 than in a region extending between two cutting tools.

The spacer plate 60 comprises an approximately triangular cross-sectional region which projects between two peripheral rows 14 into two adjacent undercut regions 18. The triangular cross-sectional region extends from the free end 64 radially outwards as far as a region between the cutting tools. The width of the free end 64 of the spacer plate 60 corresponds essentially to the distance between two adjacent plate-form holders 30, while the width of the radially outer region 62 corresponds approximately to the distance between two cutting tools of adjacent peripheral rows 14.

The design of a preferred chisel-like cutting tool 40 is described below by reference to FIG. 4. The cutting tool in the form of a chisel 40, for example a round shank chisel, comprises a plurality of pointed removal tips 42, which are arranged annularly on a chisel head. FIG. 4 shows the chisels 40 in a side view in rotational direction of the cutting wheel 10. The axially outer removal tips 42*a* are more greatly inclined in relation to the radial orientation than the axially inner removal tips 42*b*. In addition, the distance between the axially outer removal tips 42*a* in axial direction is smaller than the distance between the axially inner removal tips 42*b*. Through this design of the cutting tools, a particularly effective full cut of a cutting wheel 10 can be produced. The more inclined, outer removal tips 42*a* ensure effective chipping off of ground 100, so that ground 100 can efficiently be removed also in the area between two peripheral rows 14, through which the spacer plate 60 projects.

The removal of ground 100 by means of the cutting tools shown is schematically indicated in the top illustration of FIG. 4. The removal tips 42 arranged according to the invention bring about—upon rotation of the cutting wheel 10 according to the provisions—a removal surface with a trough-like cross-section.

The spacer plate 60 according to the invention reliably removes ground material from the undercut regions 18 between two peripheral rows 14 and thus increases the efficiency of the cutting process by preventing the clogging of the intermediate spaces 15 between the peripheral rows 14. In particular the projection 66 of the spacer plate offers a possibility, in the case of a cutting wheel with chisels 40, to remove hard ground material, in particular rock and stone layers, reliably from the intermediate space 15 between the holding plates 30. The spacer plate 60 is suited in particular also for use in cutting wheels with different cutting tools, for example both teeth with linear cutting edge and also chisels with pointed removal tip.

The trench cutter according to the invention and the cutting wheel according to the invention facilitate a particularly efficient and economic creation of a cutting slot, in particular when cutting through ground layers of different hardness. The cutting wheel according to the invention constitutes a multi-functional wheel.

The invention claimed is:

1. A cutting wheel for a trench cutter having a drum-like base body, on the outer periphery of which stationary holders are arranged in at least one peripheral row, in which holders cutting tools are received for removing ground, wherein in the at least one peripheral row, chisels with a substantially pointed removal tip and also cutting teeth with a substantially linear cutting edge are arranged as cutting tools, a plurality of chisels are arranged upstream of a cutting tooth in the removal rotation direction, at least one of the cutting teeth being disposed in a removal shadow of the at least one chisel, the plurality of chisels are radially oriented at different angles with respect to each other and inclined varyingly in an axial direction, wherein upon rotation of the cutting wheel a removal surface with a trough-like cross-section is formed by the plurality of chisels, and the plurality of chisels comprise more than three chisels.

2. The cutting wheel according to claim 1, wherein a first chisel is radially orientated, a second chisel is angled laterally in an axial direction of the cutting wheel and a third chisel is angled laterally in a contrary axial direction.

3. The cutting wheel according to claim 1, wherein at least one chisel is arranged upstream of a cutting tooth in a removal rotation direction, wherein the removal tip of the chisel projects in a defined manner in radial direction in relation to the cutting edge of the cutting tooth.

4. The cutting wheel according to claim 1, wherein a sheet metal ring is welded to the outer periphery of the drum-like base body, in which sheet metal ring the chisels and the cutting teeth of a peripheral row are arranged.

5. The cutting wheel according to claim 4,
wherein
the sheet metal ring comprises radially open first recessed which are adapted to receive the chisels and radially open second recesses which are adapted to receive the cutting teeth.

6. The cutting wheel according to claim 4,
wherein
receiving sockets are inserted into the sheet metal ring for releasable holding of the chisels and/or the cutting teeth.

7. The cutting wheel according to claim 6,
wherein
the individual receiving sockets are arranged in different orientations in the sheet metal ring.

8. The cutting wheel according to claim 1,
wherein
different types of cutting teeth are arranged in the at least one peripheral row.

9. The cutting wheel according to claim 1,
wherein
a plurality of peripheral rows are formed on the outer periphery of the drum-like base body, and
exclusively chisels are arranged in at least one axially outer peripheral row.

10. The cutting wheel according to claim 1,
wherein
at least one chisel and/or cutting tooth being arranged in a pivotably mounted holder in an axially outer peripheral row.

11. A trench cutter for producing a trench in the ground, with a frame, on which a plurality of cutting wheels are mounted in pairs,
wherein
at least one cutting wheel is formed according to claim 1.

12. A method for making a trench in the ground, comprising:
incorporating the trench cutter according to claim 11 into the ground and removing the ground through the cutting tools.

13. The method according to claim 12, further comprising:
in one cutting stage, milling at least one ground layer with hard ground material which is removed at least predominantly by the chisels and at least one ground layer with soft ground material through, which is removed at least predominantly by means of the cutting teeth.

* * * * *